US005848490A

United States Patent [19]

Lee

[11] Patent Number: 5,848,490

[45] Date of Patent: Dec. 15, 1998

[54] PORTRAIT DISPLAYING RECEPTACLE

[76] Inventor: Doo Young Lee, 5541 Laurel Canyon Blvd., #34, Valley Village, Calif. 91607

[21] Appl. No.: 811,034

[22] Filed: Mar. 4, 1997

[51] Int. Cl.[6] ..... A47G 1/06

[52] U.S. Cl. ..... 40/757; 40/739; 248/316.1

[58] Field of Search ..... 40/739, 759, 800, 40/790; 248/316.1, 316.4, 316.2, 316.6; 206/776, 778, 775; 403/256, 257, 201; 269/900, 305, 41, 114

[56] References Cited

U.S. PATENT DOCUMENTS 95,337 9/1869 Goulden ..... 269/900 X 4,625,951 12/1986 Yang ..... 269/900 X 4,647,027 3/1987 Shafto ..... 269/900 X

*Primary Examiner*—Cassandra H. Davis

*Attorney, Agent, or Firm*—Eugene Oak

[57] ABSTRACT

A portrait displaying receptacle comprising a transparent covering and a base, wherein a portrait is affixed to the base with a plurality of fastening members and the transparent covering is affixed to the base over the portrait, thereby fully enclosing the portrait. The plurality of fastening members each comprises a main fastening member which is affixed to the base, a screw connected to the main fastening member, and a securing pad which holds the portrait in place.

2 Claims, 10 Drawing Sheets

PORTRAIT DISPLAYING RECEPTACLE

BACKGROUND OF THE INVENTION

1. Field of the Invention

The present invention generally relates to the field of fine arts, and specifically to devices which hold and display works of art.

2. Background of the Prior Art

Two-dimensional artwork is usually displayed through the utilization of a frame which is fastened around the artwork, wherein the frame includes a fastening means to a wall, usually a metal wire or a plurality of apertures which accommodate the head of a nail or screw. A conventional frame, however, has many disadvantages. For example, a particular frame must have specific dimensions in order to properly accommodate a particular piece of artwork. In addition, a conventional frame does not provide any protection for the piece of artwork from dust, fingerprints, or harmful liquids and gases. Thus, there is a present need for an artwork receptacle which overcomes the deficiencies of a conventional frame.

The prior art in the field of artwork receptacles teaches several variations of means to hold, protect, and display various types of two-dimensional artwork such as paintings, drawings, murals, and photographs. However, none teach a portrait receptacle and displaying means as taught by the present invention.

Consequently, the primary object of the present invention is to provide a portrait displaying receptacle which securely accommodates a two-dimensional piece of artwork.

Another object of the present invention is to provide a portrait displaying receptacle which provides protection for a two-dimensional piece of artwork from dust, liquids, and other harmful substances.

A further object of the present invention is to provide a portrait displaying receptacle which is adjustable to accommodate artworks of various sizes.

SUMMARY OF THE INVENTION

The portrait displaying receptacle comprises a plurality of fastening means which secure the artwork in place, wherein the plurality of fastening means are additionally fastened to a base. A transparent protective cover fitting over the base envelops the artwork and the plurality of fastening means which maintain the artwork in place. The transparent protective cover is removable and the plurality of fastening means may be loosened thereby allowing the piece of artwork to be removed. The present invention is intended to be used to display and protect two-dimensional pieces of artwork such as paintings, drawings, murals, and photographs.

BRIEF DESCRIPTION OF THE DRAWINGS

For a better understanding of the principle and nature of the present invention, reference should be made to the following detailed description taken in connection with the accompanying drawings in which.

DETAILED DESCRIPTION OF THE PREFERRED EMBODIMENT

Figure 1:
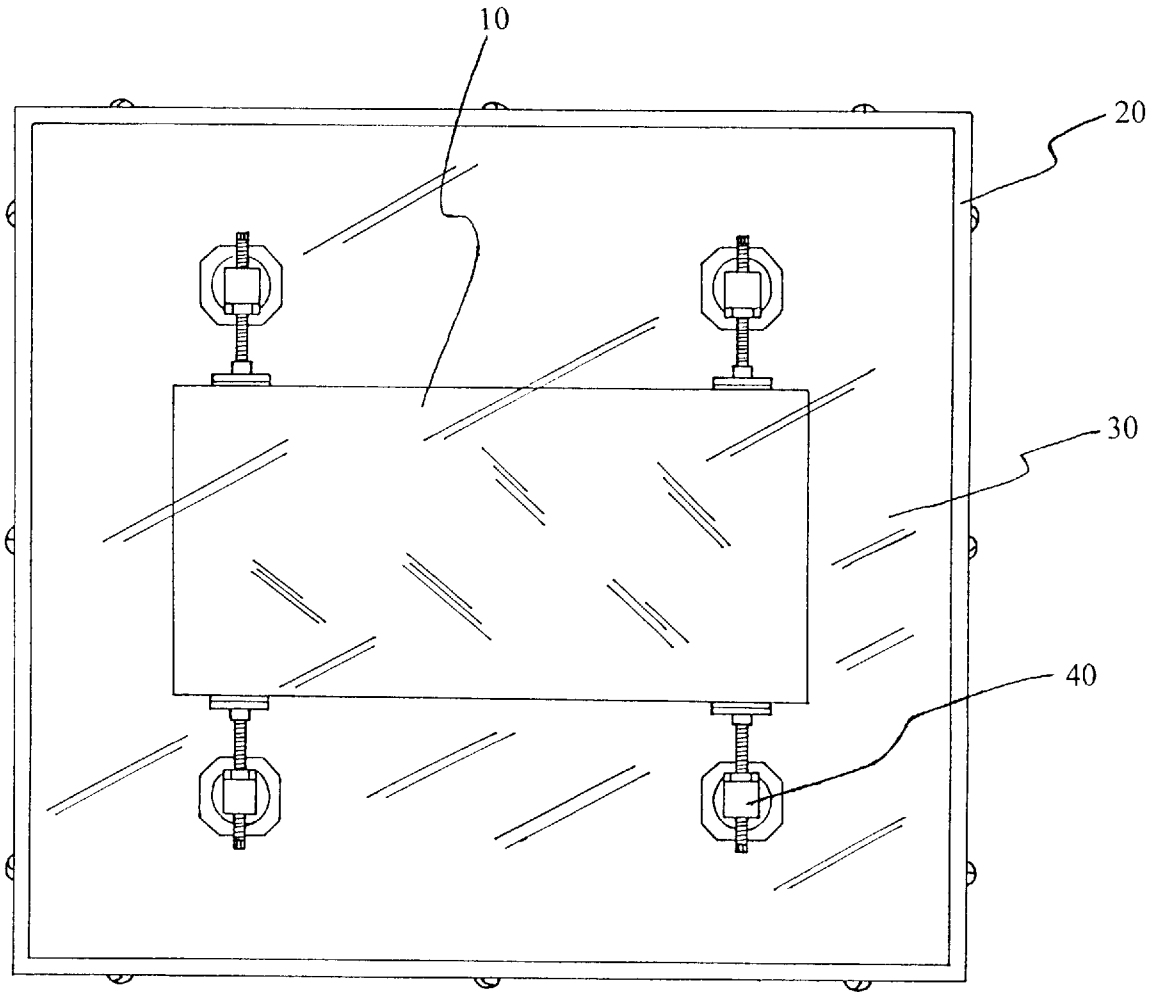
FIG. 1 is a front view of the portrait displaying receptacle.
Figure 4:
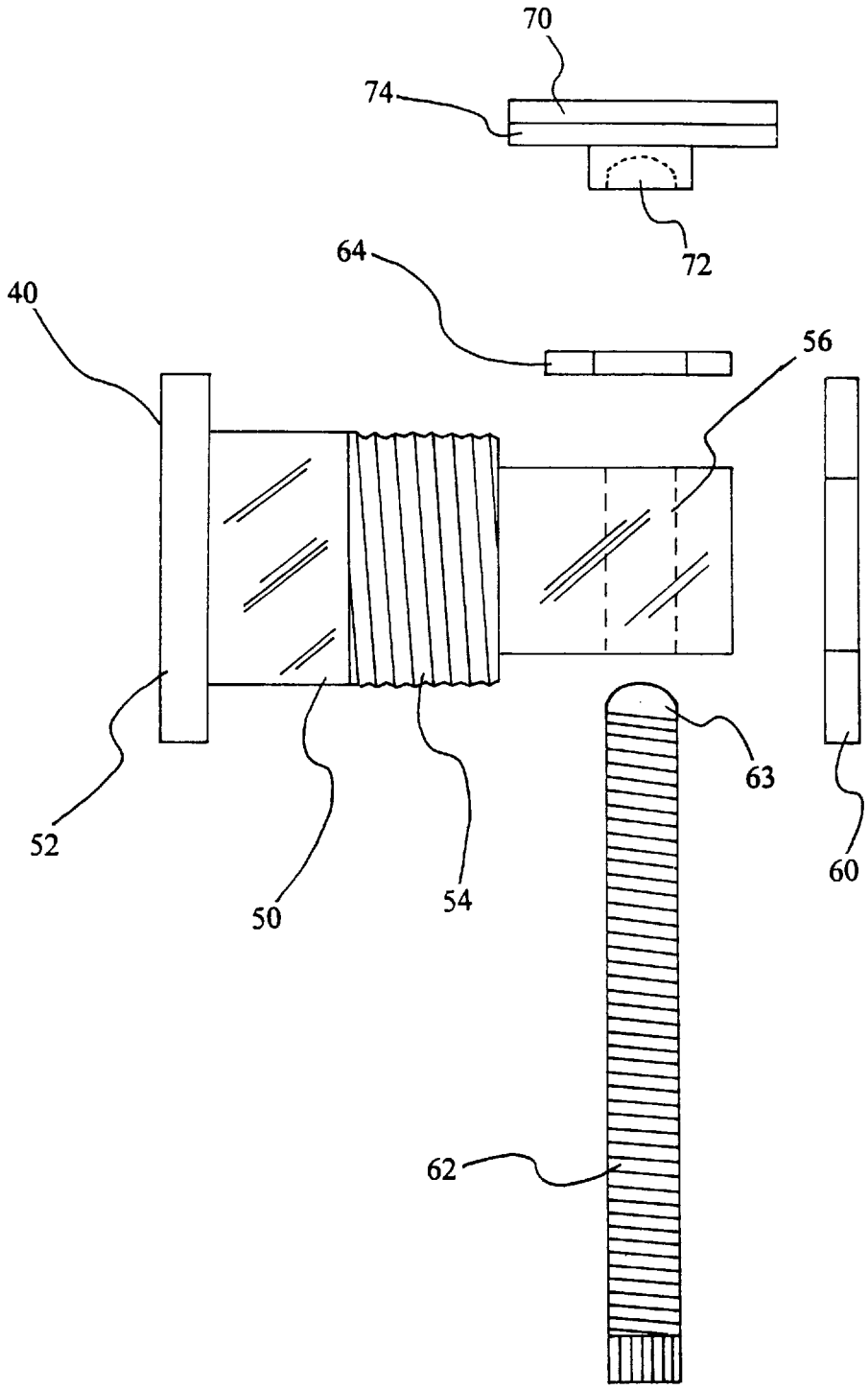
FIG. 4 is a magnified side view of the fastening means of the portrait displaying receptacle depicting the various parts of the fastening means.

Referring to FIG. 1, the portrait displaying receptacle provides means to securely display and protect a piece of artwork 10. The present invention comprises a base 20, a transparent protective covering 30, and a plurality of fastening means 40. Referring to FIG. 4, each of the plurality of fastening means 40 comprises a horizontally disposed main fastening member 50, a corresponding washer 60, a vertically disposed screw 62, a corresponding washer 64, and a securing pad 70.

Figure 2:
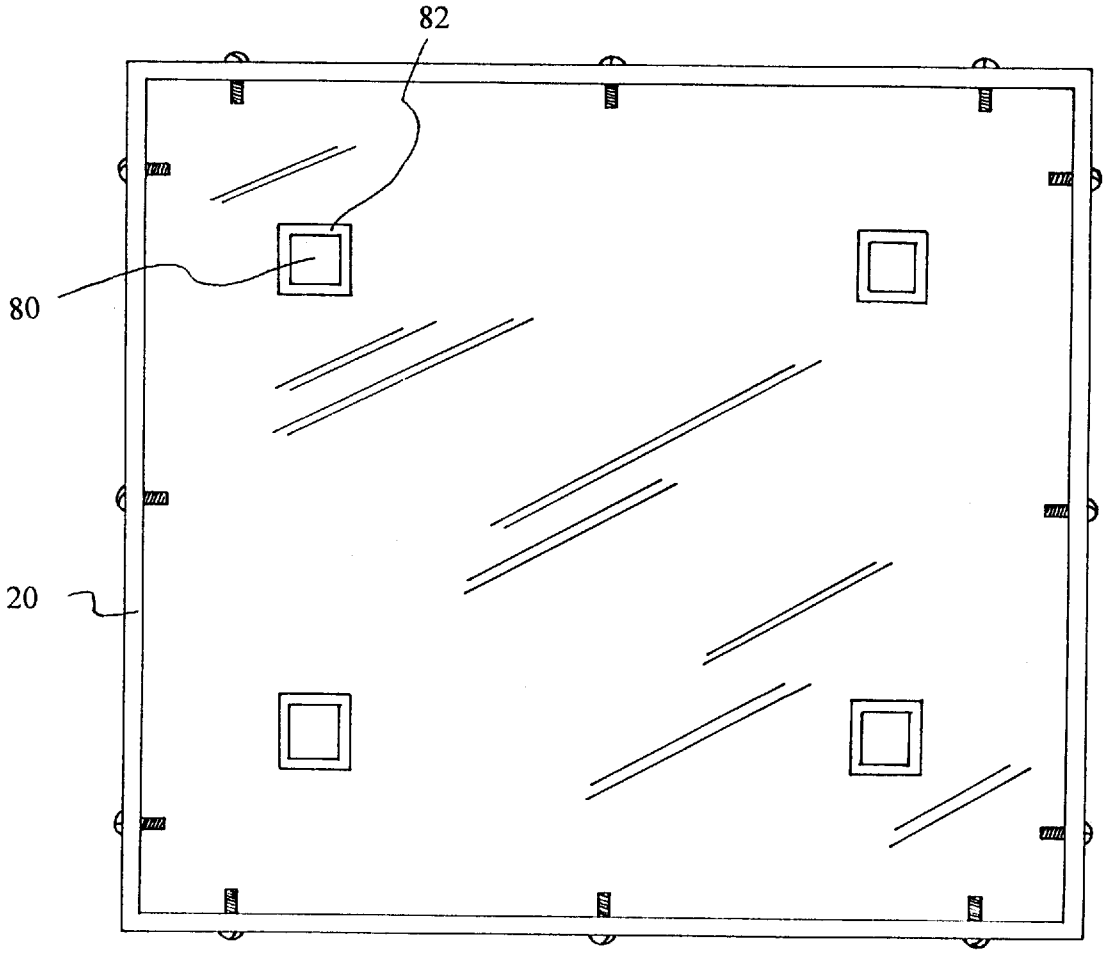
FIG. 2 is a back view of the portrait displaying receptacle.
Figure 6:
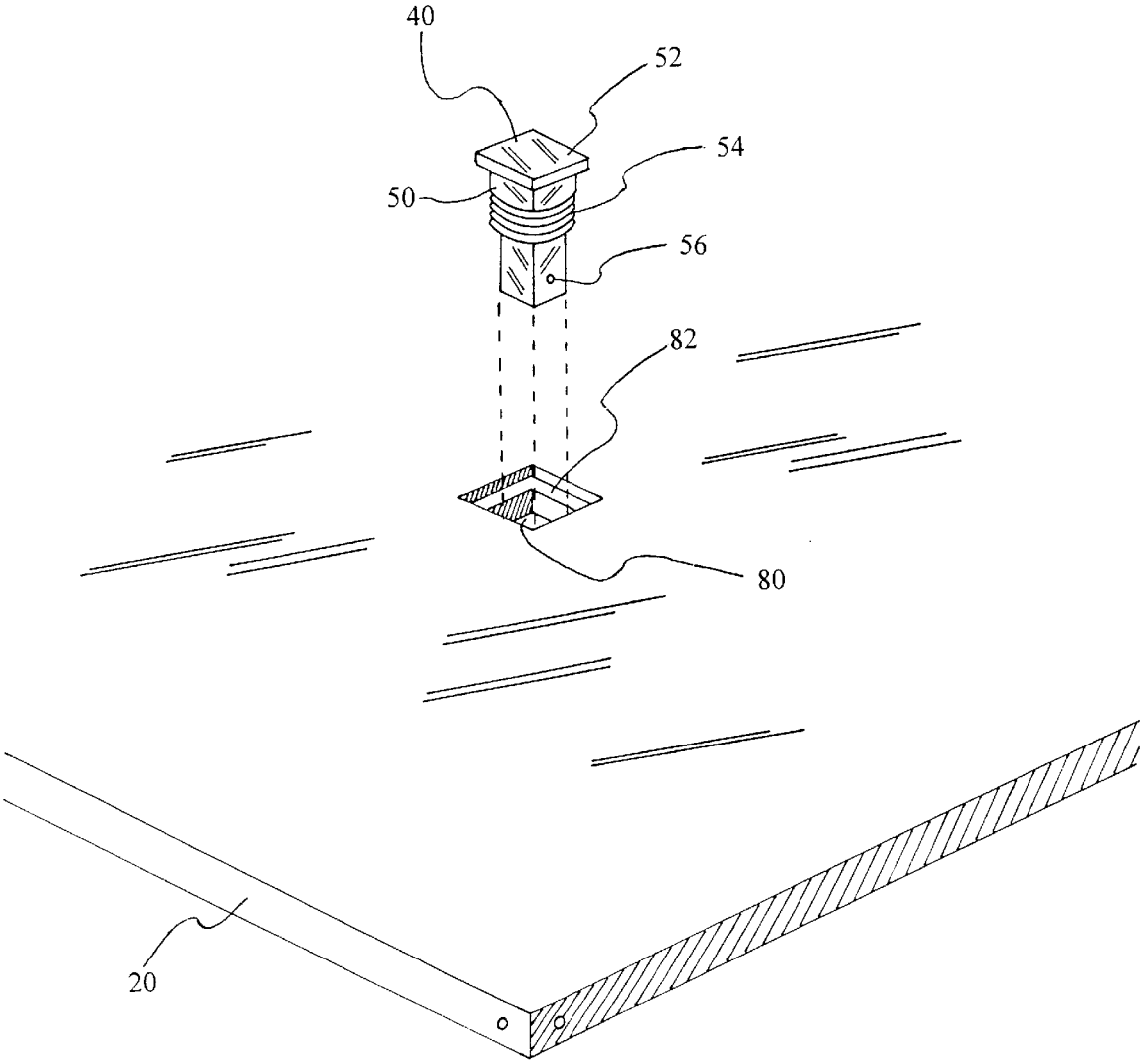
FIG. 6 is a magnified perspective view of the aperture on the base of the portrait displaying receptacle.

Referring to FIG. 2 and FIG. 6, a plurality of apertures 80 are normally disposed through the base 20 of the present invention, wherein the plurality of fastening means 40 correspond to the plurality of apertures 80, the plurality of apertures 80 being disposed in appropriate positions on the base to accommodate a piece of artwork when the plurality of fastening means 40 are in place. A flanged end 52 of the main fastening member 50 permits the main fastening member 50 to be securely inserted into the aperture 80 through the backside of the base 20, wherein a recessed portion 82 disposed around the aperture 80 accommodates the flanged end 52 of the main fastening member 50 when the main fastening member 50 is completely inserted into the aperture 80.

Figure 5:
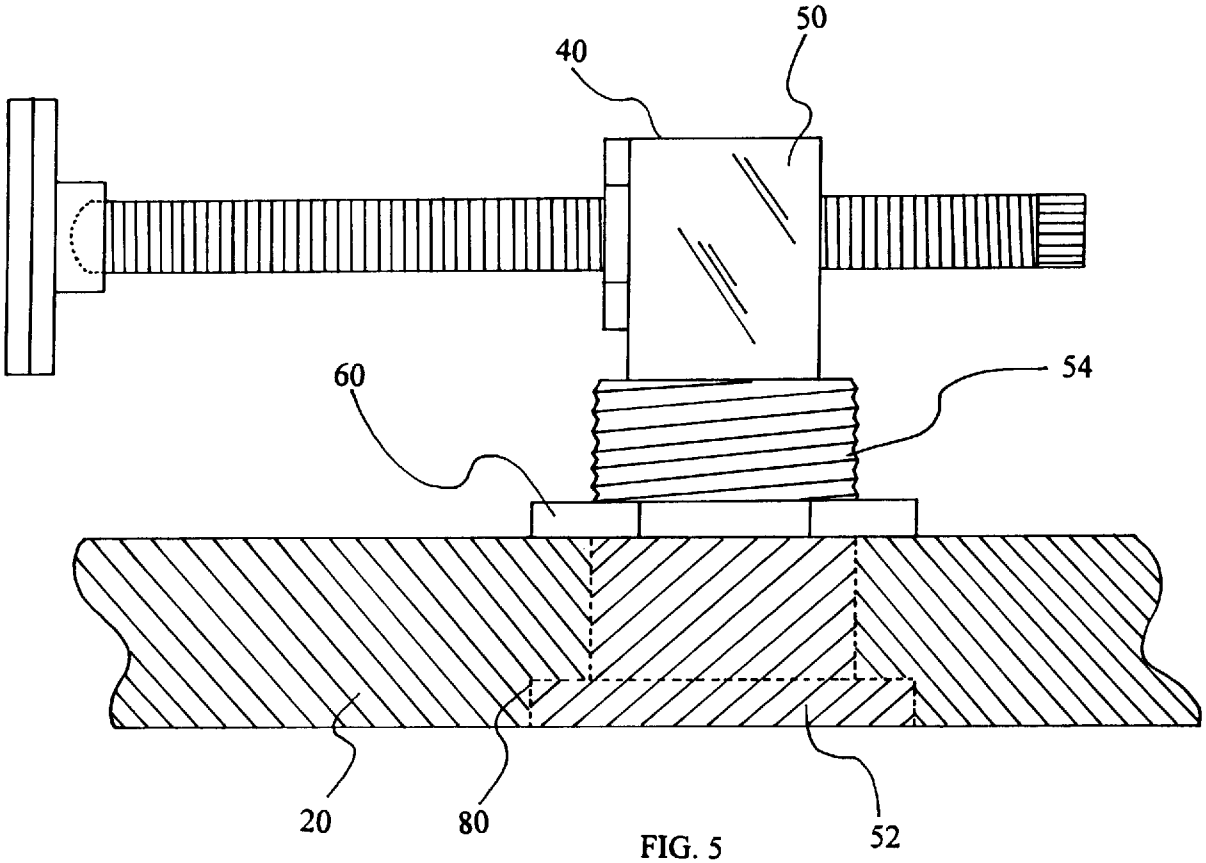
FIG. 5 is a magnified side view of the portrait displaying receptacle displaying the fully-assembled fastening means.

Referring to FIG. 4, FIG. 5 and FIG. 6, a threaded midsection 54 is disposed along the main fastening member 50, wherein the distance between the threaded midsection 54 and the flanged end 52 of the main fastening member 50 is equivalent to the width of the base 20. This allows the portion of the main fastening member 50 which includes the threaded midsection 54 to protrude normally from the front surface of the base 20, whereupon the corresponding washer 60 is screwed onto the threaded midsection 54, thereby securing the main fastening member 50 inside the aperture 80.

Figure 3:
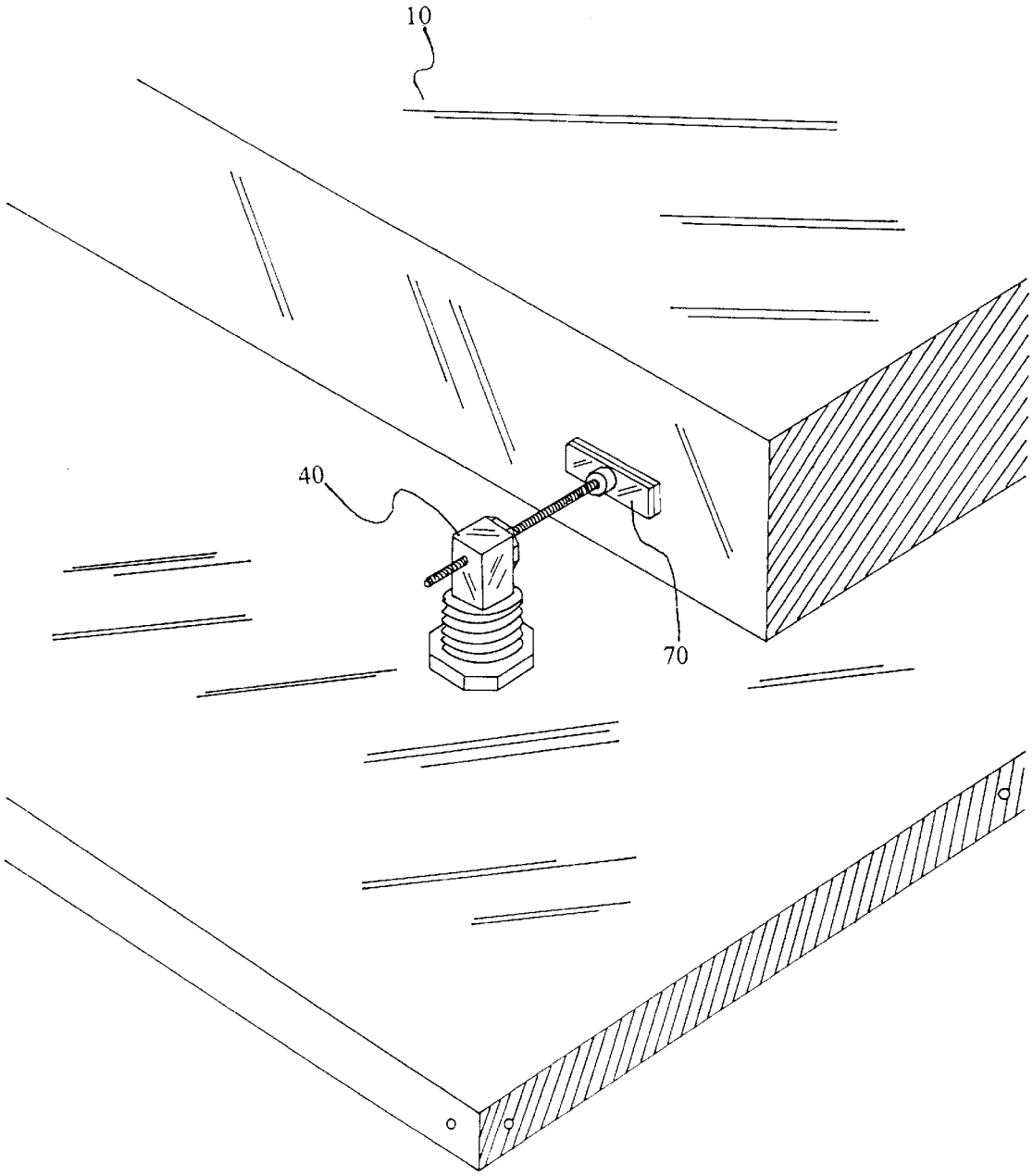
FIG. 3 is a magnified perspective view of the portrait displaying receptacle displaying the fastening means.

Referring to FIG. 4 and FIG. 6, a threaded aperture 56 vertically disposed through the main fastening member 50 accommodates the screw 62, and the corresponding washer 64 is used to fasten the screw 62 in place. The screw 62 has a [spherical end] rounded end portion 63 which corresponds to a [spherical recession] concave recession 72 disposed on the securing pad 70. A yielding material 74 is disposed on the opposite side of the securing pad 70 which is used to protect the piece of artwork 10 from damage by the securing pad 70. FIG. 3 and FIG. 5 depicts the manner in which the securing pad 70 and completely assembled fastening means 40 maintains the artwork 10 in place. A plurality of securing pads 70 are then used to hold a piece of artwork 10 in place by inserting a plurality of main fastening members 50 into the plurality of apertures 80 on the base 20, and utilizing a plurality of fastening means 40 along the circumference of the artwork 10 in the manner explained above.

Figure 7:
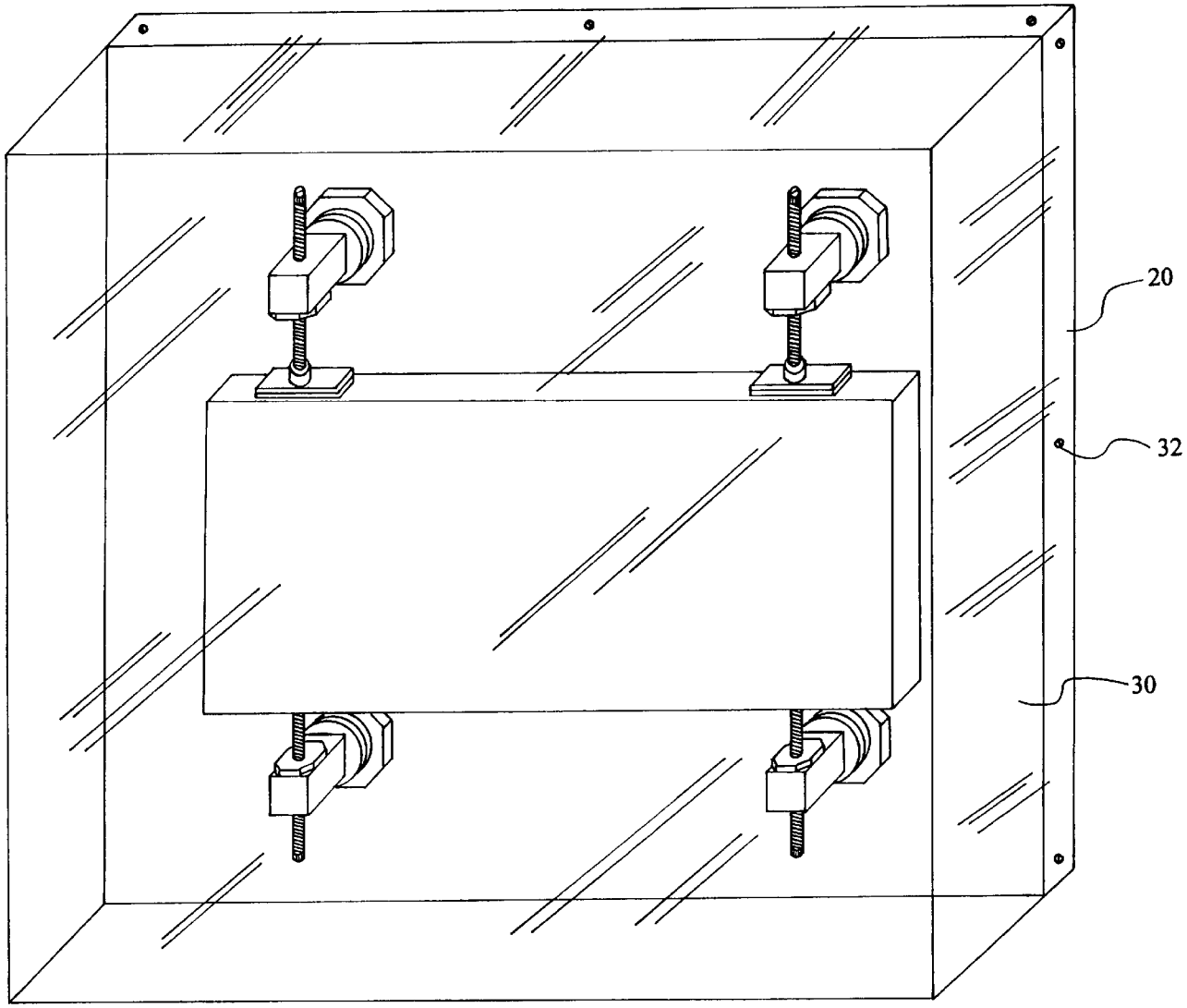
FIG. 7 is a perspective view of the portrait displaying receptacle.

FIG. 7 is a perspective view of the present invention with the transparent protective covering 30 fitted over the artwork 10 and the base 20. Screws 32 fasten the transparent protective covering 30 to the base 20 and provide convenient access to remove or replace an artwork which is currently being displayed.

Figure 8:
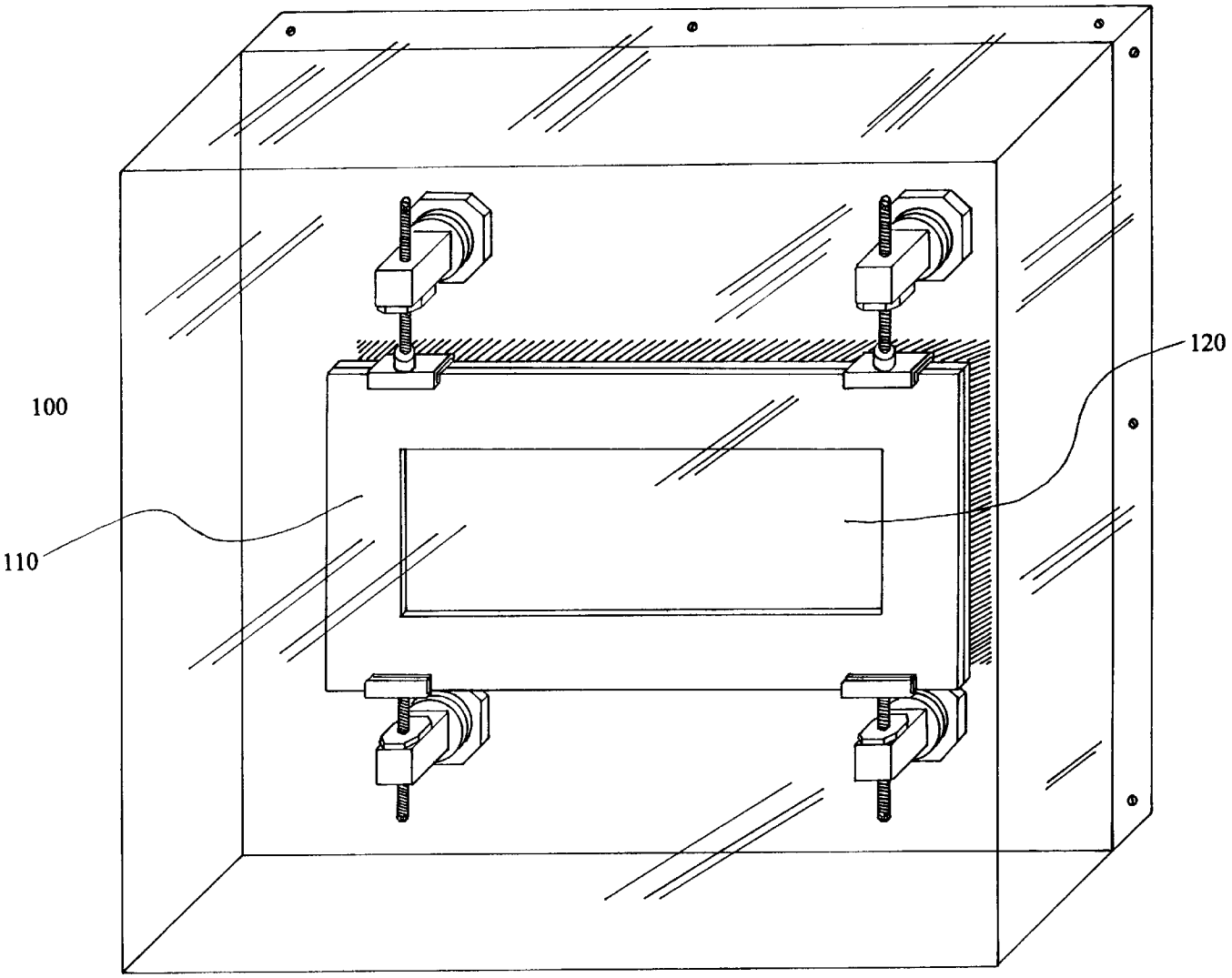
FIG. 8 is a perspective view of the photograph displaying receptacle.
Figure 9:
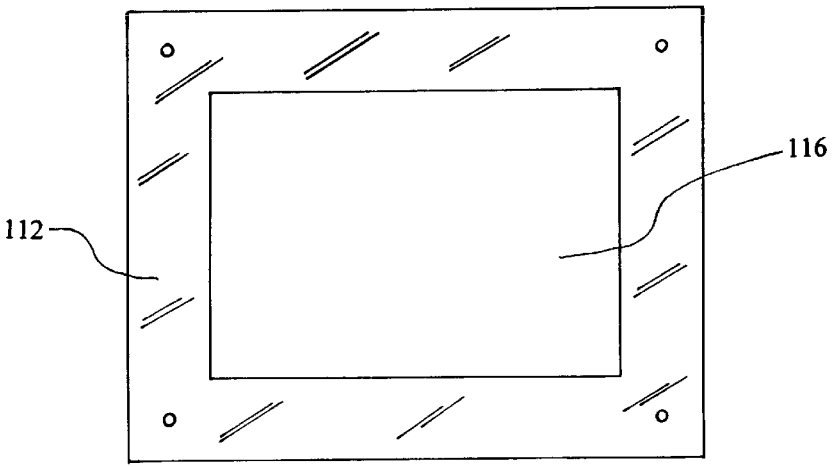
FIG. 9 is a front view of the front panel of the photograph holder.
Figure 10:
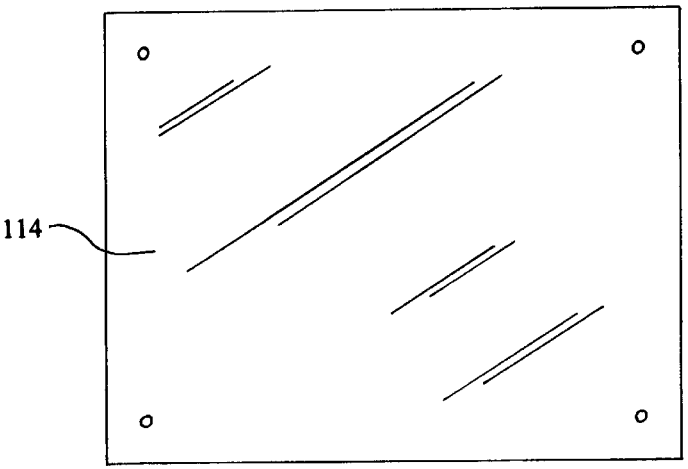
FIG. 10 is a front view of the back panel of the photograph holder.
Figure 11:
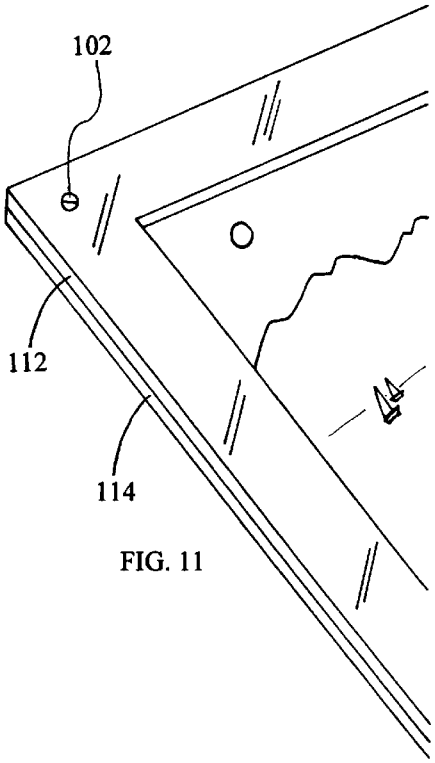
FIG. 11 is a magnified perspective view of the fastening means of the photograph displaying receptacle.
Figure 12:
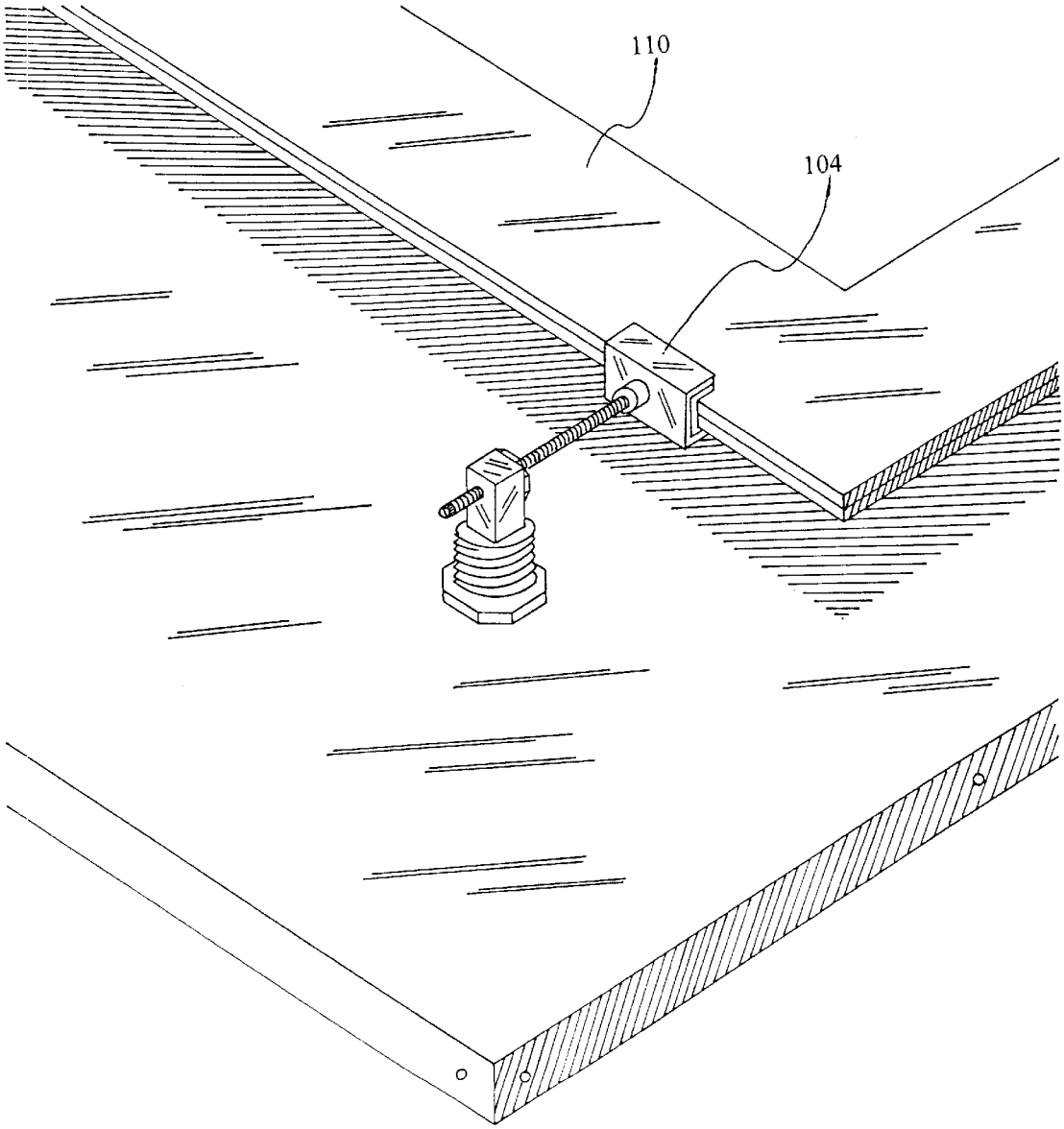
FIG. 12 is a perspective view of the bracketed securing pad of the photograph displaying receptacle.

Referring to FIG. 8, the photograph displaying receptacle 100 is depicted, wherein a photograph holder 110 is used to hold a photograph 120. Referring to FIG. 9 and FIG. 10, the front panel 112 and back panel 114 of the photograph holder 110 are depicted, respectively. The front panel 112 has an aperture 116 which permits the photograph 120 to be seen, wherein the aperture 116 is slightly smaller than the photograph 120 to prevent the photograph 120 from falling out of place. Referring to FIG. 11, a plurality of fastening means 102 are used to fasten the front panel 112 and back panel 114 together, thus securing them in place. Referring to FIG. 12, bracketed securing pads 104 may be used instead of flat securing pads to hold the photograph holder 110 in place.

The base 20 may have a means for which the receptacle 10 may be hung on the wall. A plurality of recessions accommodating a plurality of nail heads or screw heads is disposed on the back side of the base 10, thereby allowing the portrait displaying receptacle 10 to be hung on a vertical surface.

What is claimed as being new and therefore desired to be protected by Letter Patent of the United States is as follows:

1. A portrait displaying receptacle comprising a base, a transparent protective covering, and a plurality of fastening means, said plurality of fastening means for affixing a portrait onto said base, whereupon said transparent protective covering is affixed to said base thereby enclosing said portrait between said transparent protective covering and said base;

a. said base having a front and back side, said back side having a plurality of recessions accommodating a plurality of nail heads or screw heads, thereby allowing said portrait displaying receptacle to be hung on a vertical surface;

1) said base having a plurality of apertures disposed normally into said back side of said base and extending through said front side, a recessed area circumferentially disposed around each of said apertures on said back side of said base;

2) said base having said plurality of attachment means used to affix said transparent protective covering to said base;

b. each of said plurality of fastening means comprising a partially threaded main fastening member, a first washer corresponding to threading of said main fastening member, a vertically positioned screw, a second washer corresponding to said screw, and a securing pad;

1) said main fastening member having an elongated shape wherein an outward flange is disposed at one end of said main fastening member, wherein each of said plurality of apertures of said base accommodates each said main fastening member of said plurality of fastening means, said recessed area disposed around said plurality of apertures on back side of said base accommodating said outward flange of said main fastening member;

2) a threaded midsection being disposed at a length from said outward flange of said main fastening member thereby allowing said threaded midsection to be accessible from said front side of said base when said main fastening member is fully inserted into said aperture, said first washer corresponding to said threaded midsection of said main fastening member securing said main fastening member within said aperture;

3) said main fastening member having a threaded aperture vertically and normally disposed through the opposite end from said outward flange, wherein said screw is fastened through said threaded aperture, said second washer securing said screw, said screw having a rounded end portion corresponding to a concave recession of said securing pad which allows said screw to be screwed without rotating said securing pad;

4) said securing pad having a securing side whereupon said spherical recession is disposed, and a padded side adapted to be aligned with a side of the portrait, a plurality of securing pads adapted to be positioned around a circumference of the portrait, each employed with said screw, said second washer securing said screw, said main fastening member and said first washer corresponding to said threaded midsection of said main fastening member for effectively supporting a portrait within said portrait displaying receptacle.

2. A photograph displaying receptacle as mentioned in claim 1, further comprising a photograph holder, said photograph holder comprising a front panel and a back panel, said front panel having an aperture corresponding to the size and shape of a photograph to be displayed, wherein said aperture is slightly smaller than said photograph to provide a complete view of said photograph while preventing said photograph from falling out of place, said photograph holder further comprising a plurality of fastening means which fasten said front panel and said back panel together.

* * * * *